United States Patent [19]

Kim

[11] Patent Number: 5,001,393

[45] Date of Patent: Mar. 19, 1991

[54] COLOR PLASMA DISPLAY DEVICE

[75] Inventor: Jung-Hea Kim, Seoul, Rep. of Korea

[73] Assignee: Samsung Electron Device Co., Ltd., Kyonggi, Rep. of Korea

[21] Appl. No.: 403,344

[22] Filed: Sep. 6, 1989

[30] Foreign Application Priority Data

Oct. 27, 1988 [KR] Rep. of Korea ..... 88-17387

[51] Int. Cl.[5] ..... H01J 17/49; H01J 1/72

[52] U.S. Cl. ..... 313/586; 313/584; 313/484

[58] Field of Search ..... 313/586, 582, 584, 484, 313/485, 506

[56] References Cited

U.S. PATENT DOCUMENTS

| | | | |
|---|---|---|---|
| 3,840,769 | 10/1974 | Yamamoto et al. | 313/506 X |
| 3,983,445 | 9/1976 | Yasuda et al. | 313/582 X |
| 3,986,074 | 10/1976 | Watanabe et al. | 313/584 X |
| 4,021,695 | 5/1977 | Kamegaya et al. | 313/484 X |
| 4,341,976 | 7/1982 | Hamlet | 313/484 X |

*Primary Examiner*—Sandra L. O'Shea

*Attorney, Agent, or Firm*—Flynn, Thiel, Boutell & Tanis

[57] ABSTRACT

A color plasma display device for preventing phosphor sputtering phenomenon and the image spread phenomenon. The phosphor coating layer is separated by a transparent insulating layer from the gas discharge space by sequentially positioning the phosphor material coating layer. A black layer containing holes therein and a transparent insulating layer below an upper glass substrate.

2 Claims, 1 Drawing Sheet

COLOR PLASMA DISPLAY DEVICE

BACKGROUND OF THE INVENTION

1. Field of the Invention

The invention relates generally to the construction of a color plasma display device, hereinafter referred to as a color PDP, and, more specifically, to a color PDP construction for preventing phosphor sputtering phenomenon and image spread phenomenon by separating the gas discharge by a transparent insulating layer.

2. Description of the Prior Art

Referring to a typical color PDP display method, when the gas of the internal cell is discharged by means of an externally applied voltage, the phosphor is excited by the ultraviolet rays generated and thus exhibits its color. Accordingly, the phosphor is required to have high light emitting efficiency with a small amount of energy. It is common for the phosphor layer to be located on the anode side for use of the large light flux.

The common color PDP has problems in that cathode sputtering can occur from the gas discharge by means of an external applied voltage. The particle sputtering adheres to the phosphor layer and coats the phosphor layer, which determines the life of a color the PDP generates. In other words, the contamination of a phosphor layer induces the breakdown voltage of a discharge. Secondly, the light emitting efficiency of a phosphor due to the shielding action from ultraviolet rays is degraded.

Meanwhile, the conventional color PDP, to realize colorization is constructed so that a phosphor is coated on an overall glass plate in a single color PDP. Because the surface phosphor layer is directly exposed to the gas discharge space, phosphor sputtering caused by the electron collision also causes another serious defect in that the cathode electrode is contaminated by the phosphor layer sputtering and the discharge efficiency thereof reduces and its life is shortened. Namely, if the cathode electrode is contaminated, the amount of electron discharge is reduced and the ionization of a gas can not be sufficiently achieved, therefore the picture quality is degraded.

This type of application is illustrated in U.S. Pat. Nos. 3,629,638, 3,644,925, and 4,352,040. In these patents a plurality of holes of the internal and external member are arranged in a predetermined pattern, the electrode is performed to accord with the hole of a member, and consequently a gas is sealed therein. Also, said first U.S. Pat. No. 3,629,638 is directed to a plasma display device that prevents the depression of a light output by radiating the emitted light outward without transmitting the light toward the electrode.

In U.S. Pat. No. 3,644,925, there is disclosed a display panel of a gas discharge that arranges the discharge-type supplementary cell not to be seen from the display surface while not preventing observation of a display character for supplying the first electron required to speedily and continually generate the discharge.

In U.S. Pat. No. 4,352,040, reference is made to a display panel displaying the dot matrix having a memory. In order to receive the anode electrode and the cathode electrode, a first groove of a plate is molded by an etching process and a second deep groove is molded by an etching or pounding process.

SUMMARY OF THE INVENTION

Accordingly, to overcome the above disadvantage, it is an object of the present invention to provide an improved color PDP having an improved resolution of the color display by preventing crosstalk phenomenon by isolating the respective pixel and, also, to protect the phosphor coating layer and the cathode electrode from phosphor sputtering. Additionally, the present invention can prevent phosphor sputtering by the transparent insulating layer, and prevent image spread because the dot indication layer having holes formed therein makes up the black layer.

With this object in view, the present invention resides in the integration of the phosphor coating layer, the dot indication layer having holes corresponding to the respective pixels, the transparent insulating layer below the overall glass substrate and the anode electrode formed on the transparent insulating layer.

BRIEF DESCRIPTION OF THE DRAWINGS

The preferred embodiment of the present invention will be described with reference to the accompanying drawings in which.

DESCRIPTION OF THE PREFERRED EMBODIMENTS

An example of the present invention will be described with specific reference to the appended drawings.

Figure 1:
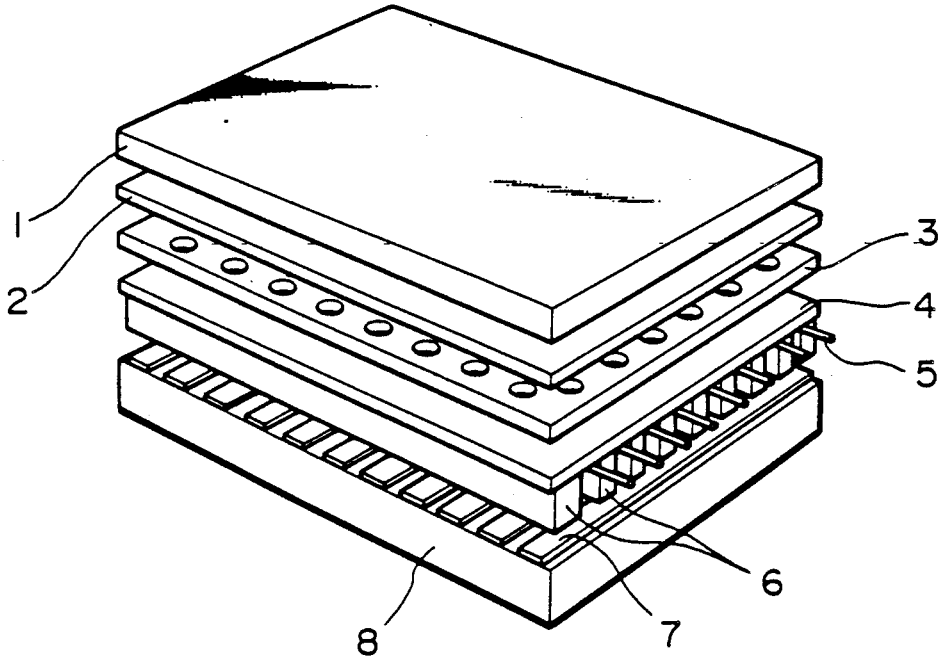
FIG. 1 is an exploded view of a color plasma display device according to the present invention.
Figure 2:
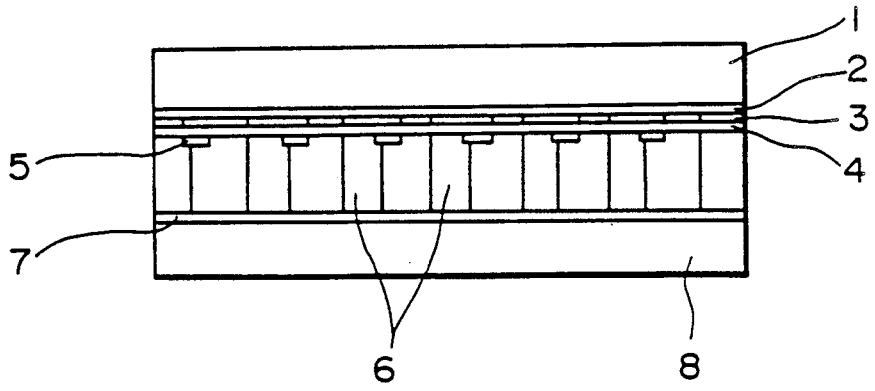
FIG. 2 is a sectional view of the color plasma display device of FIG. 1.

Referring now to FIGS. 1 and 2, the phosphor coating layer 2, the dot indication layer 3 having holes arranged corresponding to the number of pixels and the transparent insulating layer 4 below the overall glass substrate 1 are sequentially integrated. The anode electrode 5 is formed below the transparent insulating layer 4, a barrier 6 of glass paste is formed between the anode electrodes and the back glass substrate 8 having the cathode electrode 7 formed therein, is opposed to the overall glass substrate.

The present color PDP forms the phosphor coating layer 2 below the overall glass substrate 1 by utilizing the phosphor for CPT. The hole corresponding to a respective pixel of the displaying picture element is formed on said phosphor coating layer 2. That is, the hole shape corresponds to the shape of the display discharge space. Because said dot indication layer 3 is the black layer, image spread is prevented. While the dot indication layer 3 passes the ultraviolet rays generated by the gas discharge, the transparent insulating layer 4 electronically insulates the dot indicating layer 3. This transparent insulating layer 4 has a predetermined space and the anode electrode is formed underneath it. The barrier 6 below the transparent insulating layer 4 is formed by the repeated printing of glass pastes between said anode electrodes 5.

The overall glass substrate 1, formed as above, is opposed to the back glass substrate 8, which has the cathode electrode 7 formed therein. These substrate 7,8 are sealed as the frit. In the invention having the above PDP construction, when the gas discharge breakdown voltage is applied between the anode electrode 5 and the cathode electrode 7, the gas discharge is generated in the indications cell which is isolated by the barrier.

The ultra-violet rays generated from the gas discharge can permeate the transparent insulating layer 4. Said transparent insulating layer 4 is hardly permeated by the ultra-violet rays formed the lower layer of the discharge space, consequently, it is no problem that the phosphor layer is excited.

On the other hand, the ultra-violet rays transmitted through the transparent insulating layer 4 passes through the hole of the dot indication layer 3 of the black layer and to the phosphor coating layer 2. Consequently, the phosphor layer located in the pixel emits a light. As the result, the color display is realized according to the color of the phosphor layer for the CPT. Also, because the phosphor layer coating layer 2 is isolated from the gas discharge space by means of the transparent insulating layer 4, phosphor layer sputtering can be prevented. Because the dot indication layer determines the construction of the pixel according to the hole contained in the black layer, display image spread is prevented. Because the phosphor coating layer is separated from the gas discharge space by the transparent insulating layer, sputtering of the phosphor layer can be prevented. Therefore, the colorization of the gas discharge indication device is made possible by utilizing the phosphor layer for CPT as well as the life of the device can be extended. Because the dot indication layer has holes contained therein corresponding to the pixel and makes up the black layer, image spread phenomenon does not affect the phosphor layer at the position of the designated pixel. Due to this construction which eliminates crosstalk phenomenon, the resolution is improved.

It will be appreciated that the present invention is not restricted to the particular embodiment that has been described hereinbefore, and that variations and modifications may be made therein without departing from the spirit and scope of the invention as defined in the appended claims and equivalents thereof.

What is claimed is:

1. A color plasma display device comprising:

an upper glass substrate;

a phosphor layer provided underneath said upper glass substrate;

a black layer having a plurality of holes contained therein provided underneath said phosphor layer, each of said plurality of holes corresponding to a respective pixel;

a transparent insulating layer provided underneath said black layer;

anode means and cathode means provided underneath said transparent insulating layer; and a lower glass substrate provided underneath said anode means and said cathode means.

2. The color plasma display device of claim 1, wherein a glass barrier is provided between the transparent insulting layer and the lower glass substrate.

* * * * *

UNITED STATES PATENT AND TRADEMARK OFFICE

CERTIFICATE OF CORRECTION

PATENT NO. : 5 001 393

DATED : March 19, 1991

INVENTOR(S) : Jung-Hea Kim

It is certified that error appears in the above-identified patent and that said Letters Patent is hereby corrected as shown below:

Column 4, line 28; change "insulting" to ---insulating---.

Signed and Sealed this

Twentieth Day of October, 1992

*Attest:*

DOUGLAS B. COMER

*Attesting Officer*

*Acting Commissioner of Patents and Trademarks*